US006003979A

United States Patent [19]

Schneider et al.

[11] Patent Number: 6,003,979

[45] Date of Patent: Dec. 21, 1999

[54] GRAY SCALE PRINTING WITH HIGH RESOLUTION ARRAY INK JET

[75] Inventors: John M. Schneider; Michael J. Piatt; Surinder K. Bahl, all of Dayton, Ohio

[73] Assignee: Scitex Digital Printing, Inc., Dayton, Ohio

[21] Appl. No.: 08/379,936

[22] Filed: Jan. 27, 1995

[51] Int. Cl.[6] ..... B41J 2/07

[52] U.S. Cl. ..... 347/74

[58] Field of Search ..... 347/74, 76, 77, 347/15, 73, 75, 80

[56] References Cited

U.S. PATENT DOCUMENTS

| | | | |
|---|---|---|---|
| 3,373,437 | 3/1968 | Sweet et al. | 347/74 |
| 4,074,278 | 2/1978 | Robertson | 347/76 |
| 4,122,458 | 10/1978 | Paranjpe | 347/77 |
| 4,129,875 | 12/1978 | Ito et al. | 347/80 |
| 4,255,754 | 3/1981 | Crean et al. | 347/90 |
| 4,427,986 | 1/1984 | Iyoda et al. | 347/76 |
| 4,550,323 | 10/1985 | Gamblin | 347/74 |
| 4,613,871 | 9/1986 | Katerberg | 347/76 |
| 4,620,196 | 10/1986 | Hertz et al. | 347/15 |
| 4,636,808 | 1/1987 | Herron | 347/76 |
| 4,698,123 | 10/1987 | Link et al. | 216/24 |
| 4,698,642 | 10/1987 | Gamblin | 347/74 |
| 4,751,517 | 6/1988 | Crean et al. | 347/19 |
| 5,381,170 | 1/1995 | Mutoh | 347/74 |

FOREIGN PATENT DOCUMENTS

| | | | |
|---|---|---|---|
| A-0098094 | of 0000 | European Pat. Off. . | |
| 63-182153 | 7/1988 | Japan | 347/75 |
| WO 91/07283 | of 0000 | WIPO . | |

OTHER PUBLICATIONS

IBM Technical Disclosure Bulletin vol. 21 No. 2 Jul. 1978.

*Primary Examiner*—N. Le
*Assistant Examiner*—Thien Tran
*Attorney, Agent, or Firm*—Barbara Joan Haushalter

[57] ABSTRACT

A continuous linear array ink jet system and method is capable of depositing a predetermined amount of printing fluid of at least one color onto a linear array of pixels to form a predetermined image to be printed on a substrate. The invention comprises a chamber in fluidic connection to a source of pressurized print fluid. A plurality of orifices are situated in fluidic connection with the chamber to form an array of streams of print fluid from the plurality of orifices. Stimulation is used to synchronize break-up of the streams of print fluid into uniform streams of uniformly spaced drops. The printed density of the linear array of pixels is controlled by controlling the number of uniformly spaced drops on each pixel of the linear array of pixels, dependent on color density to be printed, whereby a totality of printed pixels forms a continuous tone value required to form the predetermined image to be printed.

16 Claims, 3 Drawing Sheets

GRAY SCALE PRINTING WITH HIGH RESOLUTION ARRAY INK JET

TECHNICAL FIELD

The present invention relates to a method and apparatus for high quality, high speed, ink jet printing and, more particularly, to high quality printing of process color and black and white images by placing variable optical density picture elements (pixels) onto a substrate at high spatial resolution.

BACKGROUND OF THE INVENTION

In continuous ink jet printing, ink is supplied under pressure to a manifold region that distributes the ink to a plurality of orifices, typically arranged in a linear array(s). The ink discharges from the orifices in filaments which break into droplet streams. The approach for printing with these droplet streams is to selectively charge and deflect certain drops from their normal trajectories. Graphic reproduction is accomplished by selectively charging and deflecting drops from the drop streams and depositing at least some of the drops on a print receiving medium while other of the drops strike a drop catcher device. The continuous stream ink jet printing process is described, for example, in U.S. Pat. Nos. 4,255,754; 4,698,123 and 4,751,517, the disclosures of each of which are totally incorporated herein by reference.

In recent years, the use of the flat face charging scheme described in U.S. Pat. No. 4,636,808 has enabled the spatial resolution of binary array ink jet systems to increase dramatically. This has meant better print quality for high speed text and line drawing applications. In order to improve the quality of pictorial images, however, improvements are needed. Present array ink jet systems print in a binary fashion; in each pixel, they either print a drop of ink or no ink at all. Some pictorial work has been done with binary systems by using various algorithms in which sets of pixels are grouped together to enable the average gray level over the group of pixels to be close to the desired gray level needed in the picture. This process is known in the art as "dithering". In this process, the action of achieving the proper gray level over the group of binary cells detracts from the sharpness (resolution) of the image. A large number of dithering techniques have been described, but all of them group sets of pixels together and result in images which appear "course" or "grainy" to the eye. That is, they trade off graininess and sharpness for the ability to simulate the printing of gray scale images with a binary printing technology.

The image quality of the ink jet array images can be dramatically improved if the color density in each pixel can be varied over a range. Techniques described in U.S. Pat. No. 4,636,808 regarding high spatial density array printing, and U.S. Pat. No. 4,620,196, which deals with printing a variable number of drops on each pixel, are useful for improving image quality. The need for a continuous ink jet system suited to charging arrays of drops at high spatial frequency, utilizing planar charging has been satisfied by U.S. Pat. No. 4,636,808. This patent describes a "flat face" drop charging and deflection scheme for use in a binary printing system. Implicit in the operation of the system is the idea that there are always non-printing drops in the drop stream, and those skilled in the art have observed that these non-printing drops play an important role in developing the electric field which causes drop deflection and selection (see, for example, U.S. Pat. No. 4,613,871.)

It is seen, however, that there is a need for a continuous ink jet system wherein the amount of ink printed in each pixel by the ink jet array can be controlled. The present invention applies techniques used in conventional lithographic and gravure printing to array ink jet systems so that gray scale printing can be dramatically improved.

SUMMARY OF THE INVENTION

This need is met by the present invention which discloses the use of flat face charging array ink jet for printing gray scale images.

In accordance with one aspect of the present invention, a continuous linear array ink jet apparatus and method deposits a predetermined amount of printing fluid of at least one color onto a linear array of pixels. The apparatus comprises a chamber in fluidic connection to a source of pressurized print fluid. A plurality of orifices in fluidic connection with the chamber forms an array of streams of print fluid from the orifices. Stimulation means synchronize the break-up of the streams of print fluid into uniform streams of uniformly spaced drops, the stimulation means being responsive to signal means which insures that the stimulation occurs at a predetermined frequency, the stimulation means creating generally in phase drop break-up of neighboring streams. Phase means responsive to the signal means generate a reference signal in a fixed relationship to the phase of the break-off of the plurality of jets in the neighborhood. Image control means contains information necessary to print desired image pixel patterns, and are operable to control a plurality of voltage source means, the a plurality of voltage source means responsive to the image control means and the reference signal, and operable to provide a predetermined charge voltage level corresponding to each of the plurality of drops, and using the reference signal to properly phase the charging voltages to the jet break-up. Planar charging means have a plurality of charging electrodes individually responsive to the voltage means, each of the plurality of charging electrodes positioned in close proximity to the drop break-off point of the plurality of jets in the array, and operable to charge the drops to a predetermined level according to the potential on the corresponding one of the plurality of charging electrodes. The improvement of the present invention comprises means for controlling printed density of the linear array of pixels by controlling the number of drops on each of the pixels dependent on the color density to be printed, whereby the totality of the printed pixels forms the continuous tone value required to form the predetermined image to be printed.

An object of the present invention is to provide small jet diameter, and a drop generation rate high enough to enable the desired print speed. It is a further object of the present invention to produce drops in the various jets in a given neighborhood at nearly the same phase, so that phasing may be accomplished in groups of jets, rather than each jet having its own phase. The charging capability of the present invention is able to provide adequately accurate drop placement, to allow the multiple print drops per spot to land on essentially the same spot. Accordingly, the drop-to-drop cross-talk, and the jet-to-jet cross-talk is minimized. Finally, the present invention provides the advantage of minimizing the number of guard drops required, so that print speed can be achieved with a reasonable drop generation frequency.

Other objects and advantages of the invention will be apparent from the following description and the appended claims.

DETAILED DESCRIPTION OF THE INVENTION

The present invention is described in detail with particular reference to certain preferred embodiments thereof, but it will be understood that modifications and variations can be effected without departing from the spirit and scope of the invention.

Figure 1:
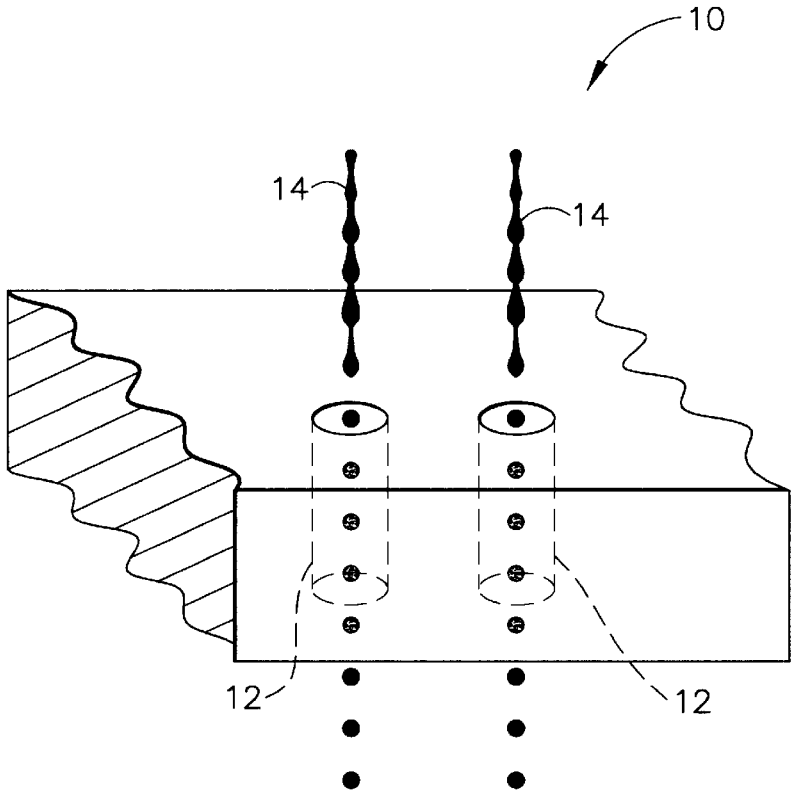
FIG. 1 is a prior art illustration of conventional charging with tunnels.

Referring to the drawings, conventional systems, such as the FIG. 1 prior art illustration of a conventional tunnel charging system 10, are incapable of charging jets at high spatial resolution. FIG. 1 illustrates a conventional method used to charge the jets by electrostatic induction in a "charging tunnel" 12. The charging tunnel 12 is an essentially closed cavity surrounding jets 14. The cavity 12 has an internal conducting coating which is electrically connected to an external source of electricity. When a potential is applied between the coating in the charging tunnel and the jet of conducting ink, an electrostatic charge is induced on the conducting jets, which are grounded through the system (not shown) which generates the drops.

An alternative embodiment of the older technology well known in the art, uses slots, rather than tunnels, for charging. In either of these embodiments, the spatial density of the jets is limited by the ability to make a mechanical structure to effectively surround the jets so they are electrostatically isolated. Tunnels with appropriate mechanical strength can be fabricated at about 75 tunnels (or jets) per inch; slots at about 100 jets per inch.

It is highly desirable to be able to generate jets and independently charge drops at much higher spatial frequencies. To achieve this purpose, the geometry shown in FIG. 3 has been devised. With the arrangement of FIG. 3, jets can be placed very close together to achieve high resolution printing. This technology has been used to make commercial products at 300 jets per inch. The enabling feature is the idea that individual drops are formed from a jet at a position closely spaced to an individual conducting electrode on a planar charge plate. The drops are charged by electrostatic induction from the charged conductor. The electrodes are called charging electrodes. The plurality of charging electrodes are attached to a planar surface to form a charge plate. The charge electrodes can be produced by various photo-forming techniques known in the photo-fabrication art. No mechanical features are needed to form the charging surfaces so the spatial frequency at which the conductors can be fabricated is not limited by mechanical considerations.

Figure 3:
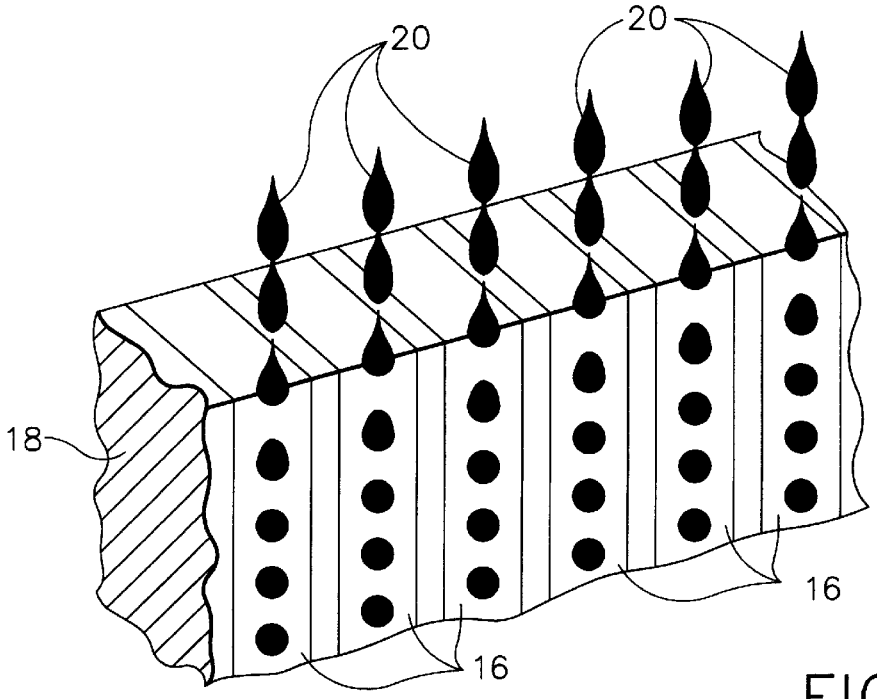
FIG. 3 is a magnified isometric view of the face of the charge plate of FIG. 2, with the ink jets disposed in front of the charge plate.
Figure 2:
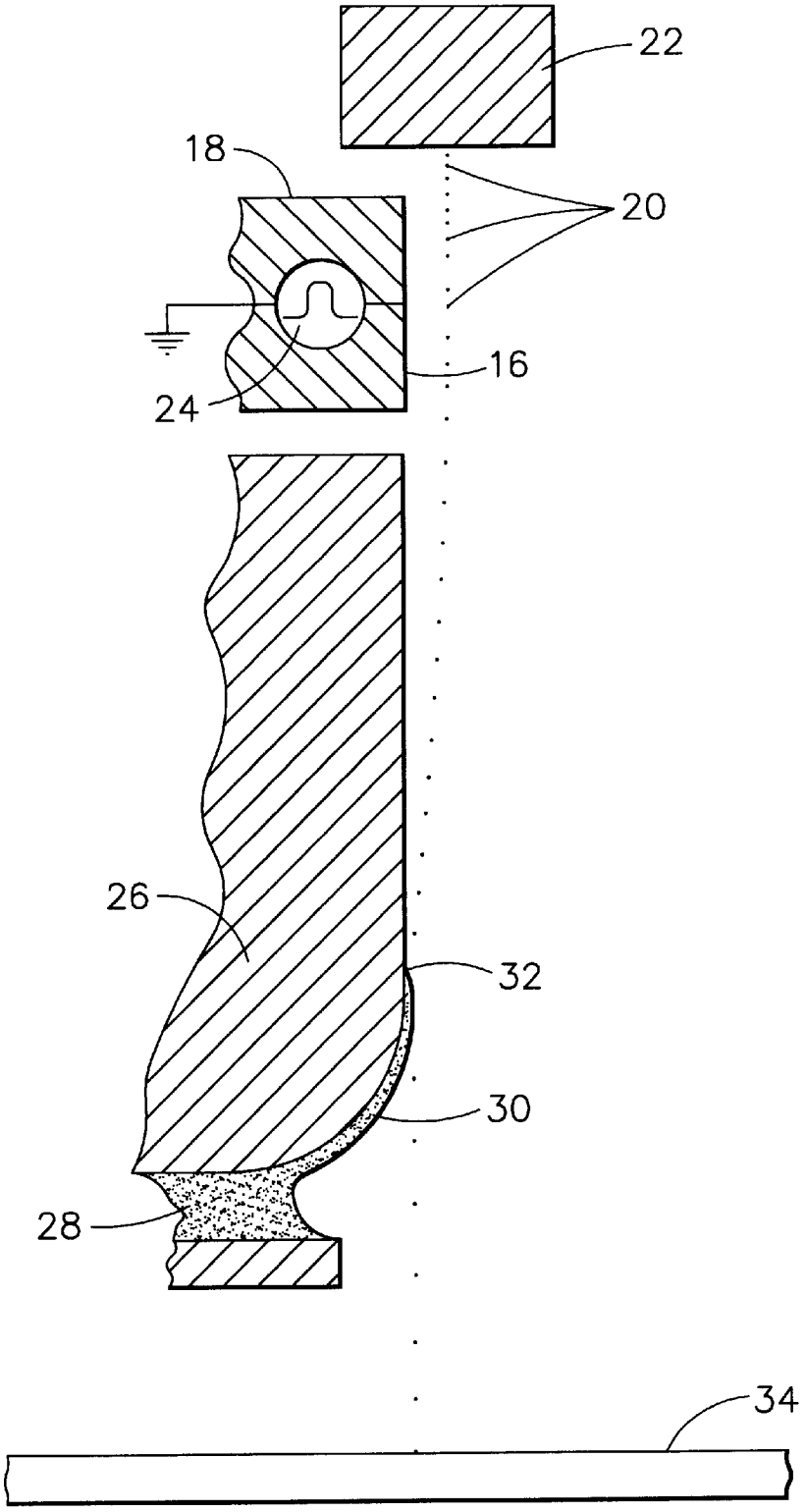
FIG. 2 is a side view of a continuous ink jet system of the type suitable for use with the gray scale printing concept of the present invention.

The present invention relates to the type of continuous ink jet system illustrated in FIG. 2. A plurality of jets is created at high spatial resolution by a drop generator, which stimulates the natural break-up of jets into uniform streams of droplets. FIG. 2 is a side view of a continuous ink jet system of the type suitable for use with the gray scale printing concept of the present invention. FIG. 3 is an isometric view of the face of a charge plate of FIG. 2, with the ink jets disposed in front of the charge plate.

Continuing with FIGS. 2 and 3, a plurality of conducting elements, or charge leads 16, are located on a planar charge plate 18. A plurality of streams of drops 20 are supplied by drop generator 22. A plurality of independently switchable sources 24 of electrostatic potential are supplied to the plurality of charge leads 16. A catcher 26 intercepts the slightly deflected streams of drops. The plurality of streams of drops impacting on the catcher forms a film of ink 30, which in turn forms a flow of ink 28, sucked away from the face of the catcher by a vacuum. Reference number 32 represents the area on the catcher at which the deflected drops impact the catcher and merge together to form a film of ink on the catcher face. The undeflected ink drops then print the image on substrate 34.

In operation, FIG. 2 represents the side view of one embodiment of the present invention and FIG. 3 represents an isometric view of the face of the charge plate of FIG. 2, with the ink jets disposed in front of the charge plate. Drop generator 22 supplies streams of essentially coplanar and collinear drops 20, parallel to the face of the charge plate 18. Each of the drop streams 20 are in linear alignment with a conducting charge electrodes 16. The streams of ink 20, before break-up into drops, are electrically conducting. When an electric potential is applied to one of the plurality of charge electrodes 16, by one of the plurality of voltage sources 24, the last drop which is still connected to the jet in front of that charge electrode acquires an electric charge by induction. By applying a predetermined voltage to any of the charge electrodes in a timed relationship to the jet break-up process, successive drops can be either charged or uncharged. Typically, at least every other drop is charged so that each charged drop experiences the electrostatic image charge of the plurality of other charged drops. In the ensemble, these electrostatic charges cause an impulsive force of electrostatic attraction to be exerted on the charged drops. In response to the impulsive electrostatic force, the charged drops are attracted towards the face of the catcher 26. Drops which are formed in front of a charge electrode which is momentarily at the same potential as the drop stream 20 are charged only by the effects of neighboring ("cross-talk") charge electrodes. The trajectory of the "uncharged" drops is not deflected towards the catcher 26, so those drops move unimpeded towards the print media 34. By appropriate programming of the plurality of charge electrodes 16 in synchronism with the break-up of the jet into a stream of drops 20, a desired pattern of drops moving towards the substrate 34 can be produced.

In typical use, two signals are critical to the operation of a printer. First, a "print enable" signal is generated. Typically, the "print enable" signal is generated by sensing means which determine when the substrate is in the correct position for printing to begin. The second signal is required to tell the printhead when to print each row of drops to form the desired image. For this, an encoder is driven in relationship to the motion of the substrate. The encoder generates print "tach pulses" at the desired pixel resolution for printing. When, the image forming electronics gets a tach pulse from the encoder, it signals the charge plate, to print the next line of pixel data. Accordingly, the drop pattern produced is varied in timed relationship with motion of the substrate 34 to the right in FIG. 2. By this means, any desired image can be formed on the moving substrate.

In high resolution ink jet printers of the type just described, various factors can affect print quality. For example, multiple drops vary the size of the printed spot, and a single drop is only a small percentage of the pixel element. Accordingly, gray is obtained by modulating the white space between drops. Also, accurate dot position within a pixel is less critical than for drop/pixel printing.

Furthermore, in high resolution ink jet printers of the type just described, there are two types of drop charging inaccuracies which, in some cases, can cause objectionable drop placement defects. One type, called drop-to-drop cross-talk, results from the influence of previously charged drops on subsequent drops in a single ink jet. Drop-to-drop cross-talk can be minimized by sending every other drop to the catcher, the "alternate guard" technique. Then, all print drops are preceded by a catch drop when they are charged. The problem with using alternate guard drop strategies is drops must be generated which are not printed. At a given drop generation frequency, f, the print speed in inches per second, S, is given by $S=f/[R(n+g)]$, where f is the drop generation frequency, R is the resolution in pixels per inch, n is the number of drops required for full coverage on a pixel, and g is the number of guard drops required per pixel. Clearly, if the number of guard drops and print drops are equal, the print speed is cut in half. However, if n is 32 and g can be as low as 3, a minimal speed reduction is incurred. In some cases, adequate operation can be obtained without use of the alternate guard technique, enabling faster printing.

The other type cross-talk, called jet-to-jet cross talk, results from the influence on drop charging of neighboring jets. In this cross-talk, the charge of the neighboring drop and the potential of adjoining charging electrodes are the basis of the problem. Jet-to-jet cross talk can be minimized by printing the odd jets on one drop cycle and the even jets on the next drop cycle. This is called odd-even printing and is described in U.S. Pat. No. 4,613,871. When this technique is utilized, at least one catch drop is provided between each print drop in each column (jet) to reduce drop-to-drop cross-talk, and each print drop has catch drops on each side to reduce jet-to-jet cross-talk.

Another technique to achieve the same result, is to adjust the charging voltage for each print drop to account for the effects of neighboring drops. This is covered in U.S. Pat. No. 4,074,278. Typically, print drops are essentially uncharged and the catch drops are charged negatively. The teaching of this patent is to compensate for the presence of nearby electrostatic influences by not bringing the voltage difference between the jet and the charge electrode to zero to produce uncharged print drops. Rather, the charge voltage is placed at an intermediate value to compensate for the influence of the preceding catch drop and the drops on adjoining jets.

In any case, drop-to-drop cross-talk is typically less than 15% of the catch drop charge. Jet-to-jet cross-talk is typically as much as 30% of the catch drop charge. Because the flat face charging system is a square law system, a 30% charging error results in only a 9% deflection error. With use of a short enough throw distance this error can be made negligible.

Given an appropriate charging method and apparatus, the central idea in this invention is to vary the number of drops placed on a particular pixel to render a gray scale effect. This implies that the jets must be smaller, or the ink lighter than is used in a binary system wherein a single drop covers and darkens a pixel completely. According to this invention, the jet diameter is typically smaller than the diameter used in a binary system. For example, if the jet diameter in a 240 dot per inch binary printer is 0.0013 inches, the diameter in a gray scale printer might be half that. Then, full coverage would take, for example, N drops. Depositing a number of drops less than N on the substrate would yield a smaller, lighter spot. Experience has shown that with full strength inks, the spot diameter produced by n drops is proportional to $\sqrt{n}$. This type functionality tends to give a very abrupt change in density for the first few drops, so either N is chosen to be a large number such as 32, or the ink concentration is decreased, or some sort of dithering among pixels is imposed. By the above method, the color density in each pixel can be varied in steps to emulate the halftone methodology utilized in conventional half-tone printing.

Figure 4:
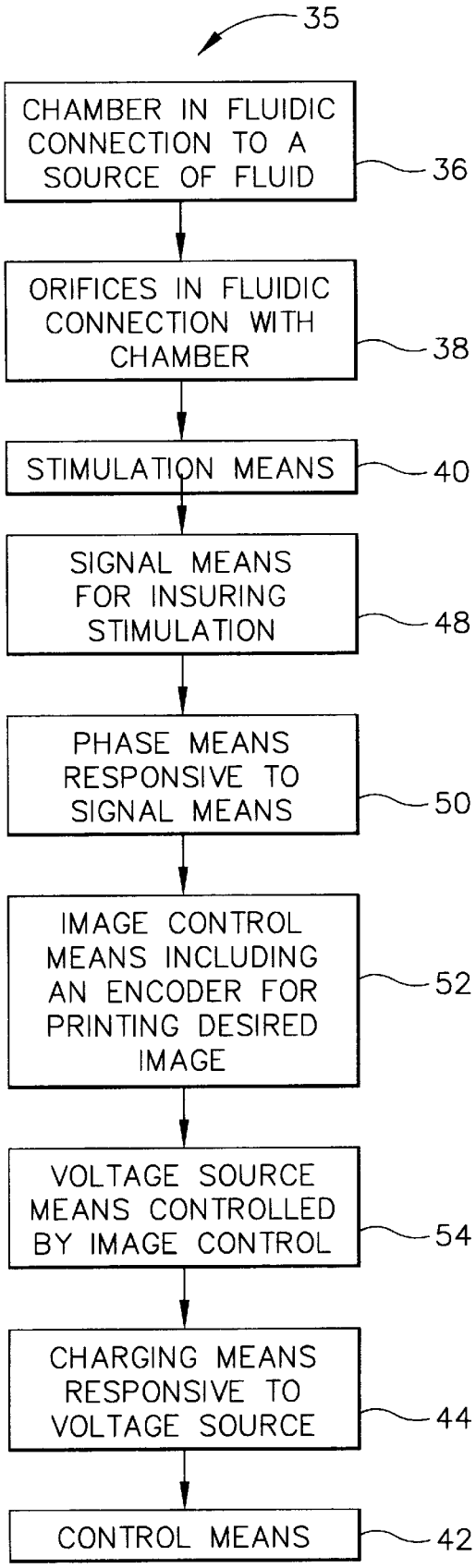
FIG. 4 is a flow chart diagram illustrating a method for achieving image printing, in accordance with the present invention.

Referring now to FIG. 4, in accordance with the present invention, a continuous linear array ink jet system and method deposits a predetermined amount of printing fluid of at least one color onto a linear array of pixels to form a predetermined image to be printed on a substrate. The system and method of the invention comprises a chamber in fluidic connection to a source of pressurized print fluid, as illustrated in block 36 of FIG. 4. A plurality of orifices are in fluidic connection with the chamber to form an array of streams of flowchart 35 of print fluid from the plurality of orifices, as shown by block 38. Stimulation means of block 40 synchronize break-up of the streams of print fluid into uniform streams of uniformly spaced drops. Printed density of the linear array of pixels is controlled at control means block 42 by controlling the number of drops to be placed on each pixel of the linear array of pixels, dependent on color density to be printed, whereby a totality of printed pixels forms a continuous tone value required to form the predetermined image to be printed.

As will be understood by those skilled in the art, the present invention also comprises charging means of block 44, shown in FIG. 4, which may be planar charging means, having a plurality of charging electrodes individually responsive to voltage source means, each of the plurality of charging electrodes positioned in close proximity to a drop break-off point of the plurality of jets in the linear array of pixels, and operable to charge the drops to a predetermined level according to potential on a corresponding one of the plurality of charging electrodes; slot charging means having a plurality of vertical slots cut into an edge of a substantially planar layer of insulating material; or tunnel charging means, having a plurality of vertical circular tunnels cut into a substantially planar layer of insulating material. An interior of each of the slots or tunnels would be coated with a conducting material in electrical connection to one of a plurality of voltage source means. The slots would be cut substantially deeper into a face of the substantially planar layer than a width of the slots, each of the slots being positioned so that a break-off point of one of each of a plurality of jets occurs within one of the plurality of vertical slots, the break-off points being substantially shielded electrostatically by conducting slots, so that the drops acquire a charge which depends on voltage on the plurality of voltage source means when the drop breaks off the jet. The tunnels would be positioned so that a break-off point of each of the plurality of jets occurs within one of the plurality of tunnels, the break-off points being substantially shielded electrostatically by the conducting tunnels, so that the drops acquire a charge which depends on voltage on the plurality of voltage source means when the drop breaks off the said jet.

Continuing with the invention, the stimulation means is responsive to signal means of block 48 which insures that stimulation occurs at a predetermined frequency, the stimulation means creating generally in phase drop break-up of neighboring streams in a neighborhood. Phase means of block 50 are responsive to the signal means to generate a reference signal in a fixed relationship to the phase of break-up of a plurality of jets in the neighborhood. The phase means uses a first phase as a common reference phase for charging potentials for a number of jets in a region, and further uses any of a plurality of additional phases, which can be different from the first phase, for different regions along the plurality of jets.

Continuing with FIG. 4, the continuous linear array ink jet system and method further comprises image control means of block 52, containing information necessary to print desired image pixel patterns, and operable to control a plurality of voltage source means of block 54. The plurality of voltage source means 54 is responsive to the reference signal from the phase means and is operable to provide a predetermined charge voltage level corresponding to each of the uniformly spaced drops. The reference signal is used to properly phase charging voltages to jet break-up. Excellent drop placement is achieved, then, by correcting print drop charging for effects of neighboring jets, and preceding drops by placing an appropriate one of a plurality of possible charging voltages on a charging electrode corresponding to each jet.

In a preferred embodiment of the present invention, aperture size of each of the plurality of orifices has a diameter in the range $0.3\ D \leqq D \leqq 0.8\ D$, where D is a nominal aperture size for a given resolution. Additionally, print addressability R is preferably in a range of 200 dots per inch $\leqq R \leqq$ 800 dots per inch for flat face charging systems, or in a range of 60 dots per inch $\leqq R \leqq$ 100 dots per inch for slot or tunnel charging systems. Of course, it will be understood by those in the art that variable quality can be obtained by trading bits/pixel and dots/inch. The maximum number of drops to be printed on a given pixel to produce a desired gray scale effect has a range of from 3 to 64 drops. Also, print speed is synchronized to the speed of generation of drops, so that n drops are generated in the time required to print one pixel, the print speed definable as f/(nR), where f is drop generation frequency. It is understood that dot placement error due to dot addressability is Pixel Spacing/Number of Drops Generated Per Pixel. In a preferred embodiment, the print speed is asynchronous to drop generation speed, a variable number of catch drops is used between pixels, and a first print drop on a next pixel is enabled by the arrival of the next pixel signal from an encoder means having a fixed relationship to the motion of the substrate.

The present invention provides for print drops directed towards a given pixel to have no guard drops between print drops. In addition, a minimum number of catch drops exist between print drops when printing at full speed is less than 64 print drops. Excellent drop placement is achieved by use of an "odd-even" printing technique, such as is described in U.S. Pat. No. 4,613,871, incorporated herein by reference, and accurate drop position is achieved with "odd/even" printing. Finally, the width of the continuous linear array ink jet is capable of being greater than one inch.

While the methodology of the present invention may appear to be very simple, it is difficult in practice because many more drops are needed for a given printing speed, and the drops needed are much smaller and more difficult to form reliably than conventional binary drops for the same print spatial frequency. However, the resulting improvement in image quality and speed achievable with the technique of the present invention compensate for any additional effort to achieve the result. It is therefore an object of the present invention to control the number of drops deposited in each pixel. According to the invention, this objective is achieved by realizing at least one or more of the following: (1) The jet diameter should be small, and the drop generation rate should be high enough to enable the desired print speed; (2) The drop generator should be capable of delivering acceptable rows and columns of drops. This means that the drops in the various jets in a given neighborhood are produced at nearly the same phase, so that phasing may be accomplished in groups of jets, rather than each jet having its own phase; (3) The charging capability should be able to provide adequately accurate drop placement to allow the multiple print drops per spot to land on essentially the same spot. Accordingly, the drop-to-drop cross-talk, and the jet-to-jet cross-talk should be minimized; and (4) The number of guard drops required should be minimized, so that print speed can be achieved with a reasonable drop generation frequency.

INDUSTRIAL APPLICABILITY AND ADVANTAGES

The present invention is useful in the field of ink jet printing, and has the advantages of improving image quality of an ink jet printing image. The present invention has the further advantage of minimizing the number of guard drops required. This, in turn, has the advantage of noticeably improving print speed of the ink jet printing system, with a reasonable drop generation frequency.

The invention has been described in detail with particular reference to certain preferred embodiments thereof, but it will be understood that modifications and variations can be effected within the spirit and scope of the invention.

What is claimed is:

1. A continuous linear array ink jet system having a continuous linear array ink jet with a width greater than one inch, the system for depositing a predetermined amount of printing fluid of at least one color onto a linear array of pixels to form a predetermined image for printing on a substrate, the system comprising:

a chamber in fluidic connection to a source of pressurized print fluid;

a plurality of orifices in fluidic connection with the chamber to form an array of streams of print fluid from the plurality of orifices;

a stimulation means for synchronizing break-up of the array of streams of print fluid from the plurality of orifices into uniform streams of uniformly spaced drops; and a means for controlling printed density of the linear array of pixels by controlling the break-up of the array of streams of print fluid from the stimulation means to control a resultant quantity of the uniformly spaced drops on each pixel of the linear array of pixels, dependent on color density, whereby a totality of printed pixels forms a continuous tone value required to form the predetermined image for printing with accurate drop position wherein print speed is synchronized to speed of generation of drops, so that n print drops are generated by said orifices in a given time frame required to print one pixel, and said print drops directed towards a given pixel have no guard drops between said print drops, wherein a maximum number of said n drops for printing on a given pixel to produce a desired gray scale effect has a range of 3 to 64 drops.

2. The continuous linear array ink jet system as claimed in claim 1 wherein the stimulation means is responsive to signal means for causing stimulation at a predetermined frequency, the stimulation means creating generally in phase drop break-up of neighboring streams in a neighborhood.

3. The continuous linear array ink jet system as claimed in claim 2 further comprising phase means responsive to said signal means for generating a reference signal in fixed relationship to phase of break-up of a plurality of jets in the neighborhood.

4. The continuous linear array ink jet system as claimed in claim 3 wherein the phase means uses a first phase as a common reference phase for charging potentials for a number of jets in a region, and further which uses a plurality of additional phases different from the first phase for different regions along the plurality of jets.

5. The continuous linear array ink jet system as claimed in claim 3 further comprising image control means containing information necessary to print said pixels for controlling a plurality of voltage sources.

6. The continuous linear array ink jet system as claimed in claim 5 wherein the plurality of voltage sources responsive to the image control means is responsive to the reference signal for providing a predetermined charge voltage level corresponding to each of said uniformly spaced drops.

7. The continuous linear array ink jet system as claimed in claim 6 further comprising means for using the reference signal to properly phase charging voltages to jet break-up.

8. The continuous linear array ink jet system as claimed in claim 6 further comprising charging means for charging the uniformly spaced drops.

9. The continuous linear array ink jet system as claimed in claim 8 wherein said charging means comprises planar charging means having a plurality of charging electrodes individually responsive to the voltage source means, each of the plurality of charging electrodes positioned in close proximity to a drop break-off point of the plurality of jets in the linear array of pixels, for charging the uniformly spaced drops to a predetermined level according to potential on a corresponding one of the plurality of charging electrodes.

10. The continuous linear array ink jet system as claimed in claim 1 wherein said print drops are excellently placed on a medium by correcting print drop charging for effects of neighboring jets, and preceding drops by placing an appropriate one of a plurality of possible charging voltages on a charging electrode corresponding to each jet.

11. The continuous linear array ink jet system as claimed in claim 1 wherein a variable number of catch drops is used between said pixels.

12. The continuous linear array ink jet system as claimed in claim 1 wherein said print drops directed towards a given pixel have no guard drops between said print drops.

13. The continuous linear array ink jet system as claimed in claim 1 wherein a minimum number of catch drops between said print drops when printing at full speed is less than 64 print drops.

14. A method for depositing a predetermined amount of printing fluid of at least one color onto a linear array of pixels to form a predetermined image for printing on a print media associated with a continuous linear array ink jet, the method comprising the steps of:

providing a chamber in fluidic connection to a source of pressurized print fluid;

fluidically connecting a plurality of orifices with the chamber to form an array of streams of print fluid from the plurality of orifices associated with a printhead;

using stimulation means for synchronizing break-up of the array of streams of print fluid from the plurality of orifices into uniform streams of uniformly spaced drops; and controlling printed density of a linear array of pixels by controlling the break-up of the array of streams of print fluid from the stimulation means to control a resultant quantity number of the uniformly spaced drops on each pixel of the linear array of pixels, dependent on color density, whereby a totality of printed pixels forms a continuous tone value required to form the predetermined image for printing, and a first print drop on a next pixel is enabled by arrival of a next pixel signal from an encoder having a fixed relationship to motion of the print media, thereby allowing printing at variable speeds such that print speed is synchronized to speed of generation of print drops, so that n print drops are generated by said orifices in a given time frame required to print one pixel and said print drops directed towards a given pixel have no guard drops between said print drops, wherein a maximum number of drops for printing on a given pixel to produce a desired gray scale effect has a range of 3 to 64 drops.

15. A method as claimed in claim 14 further comprising the step of providing slot charging means for charging slots, the slot charging means having a plurality of vertical slots cut into an edge of a substantially planar layer of insulating material, an interior of each of the plurality of vertical slots being coated with a conducting material in electrical connection to one of a plurality of voltage sources, the slots being cut substantially deeper into a face of the substantially planar layer of insulating material than a width of the slots, each of the slots positioned so that a break-off point of one of each of a plurality of jets occurs within one of the plurality of vertical slots, each break-off point being substantially shielded electrostatically by conducting slots, so that the drops acquire a charge which depends on voltage from the plurality of voltage sources when the drop breaks off the jet.

16. A method as claimed in claim 14 further comprising the step of providing tunnel charging means for charging drops, the charging means having a plurality of vertical circular tunnels cut into a substantially planar layer of insulating material, an interior of each of the plurality of vertical circular tunnels being coated with a conducting material in electrical connection to one of a plurality of voltage sources, the tunnels positioned so that a break-off point of one of each of a plurality of jets occurs within one of the plurality of tunnels, each break-off point being substantially shielded electrostatically by the conducting tunnels, so that the drops acquire a charge which depends on voltage from the plurality of voltage sources when the drop breaks off said jet.

* * * * *